United States Patent [19]

Hughes

[11] 4,152,686

[45] May 1, 1979

[54] CONNECTING MEANS FOR MAKING CONNECTIONS TO FINE WIRES

[75] Inventor: Donald W. K. Hughes, Mechanicsburg, Pa.

[73] Assignee: AMP Incorporated, Harrisburg, Pa.

[21] Appl. No.: 829,125

[22] Filed: Aug. 30, 1977

[51] Int. Cl.[2] ..... H01F 15/10

[52] U.S. Cl. ..... 336/192; 339/95 R; 339/273 R

[58] Field of Search ..... 336/192; 339/95 R, 273 R, 339/273 F; 310/71

[56] References Cited

U.S. PATENT DOCUMENTS

| | | | |
|---|---|---|---|
| 2,134,775 | 11/1938 | Bergan | 339/273 R |
| 3,812,453 | 5/1974 | Kiessling | 339/95 R X |

FOREIGN PATENT DOCUMENTS

| | | | |
|---|---|---|---|
| 1386678 | 3/1975 | United Kingdom | 339/95 R |

*Primary Examiner*—Thomas J. Kozma
*Attorney, Agent, or Firm*—Frederick W. Raring

[57] ABSTRACT

Electrical connector means for establishing an electrical connection with a fine wire (AWG 32 and finer) comprises an insulating body having a cavity extending into one surface thereof and an electrical terminal which is dimensioned to have a force fit in the cavity. The terminal comprises a contact arm and a wedge arm which is beside the contact arm and slidably held in assembled relationship therewith. The electrical connection to the fine wire is established by positioning a portion of the wire in the cavity, inserting the terminal in the cavity with the contact arm extending beside the wire, and sliding the wedge arm along the contact arm so that the wedge arm bends the contact arm towards the wire and clamps the wire between the contact arm and a wall of the cavity.

17 Claims, 15 Drawing Figures

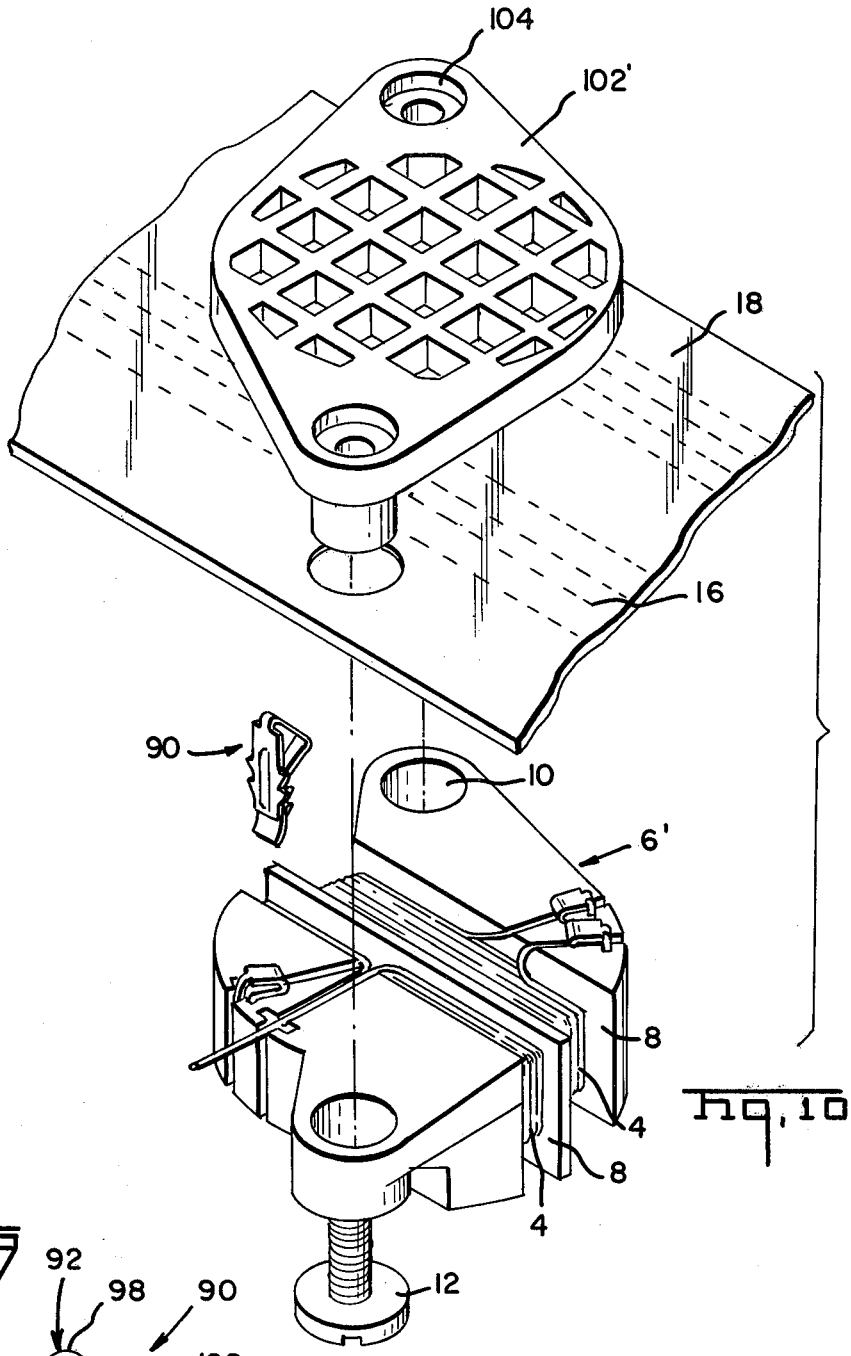
Fig. 10
Fig. 9
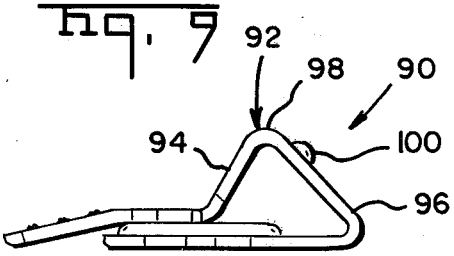

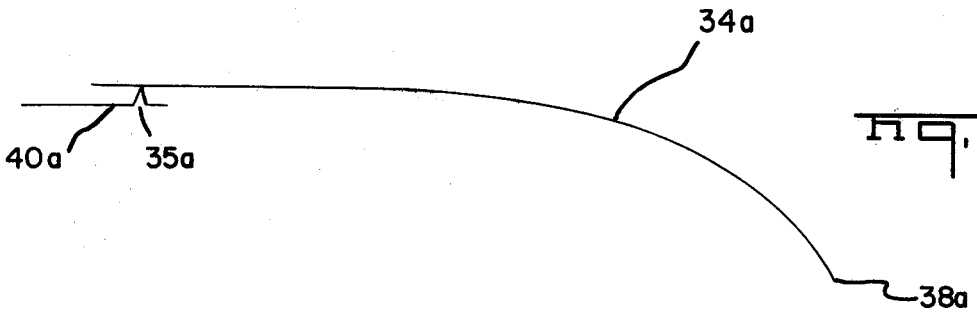
Fig. 11
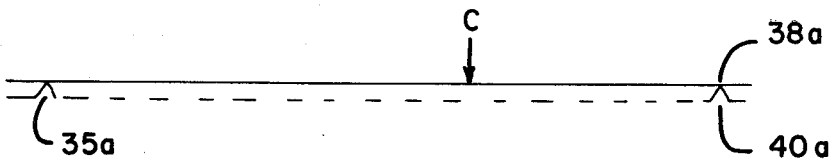
Fig. 12
Fig. 13
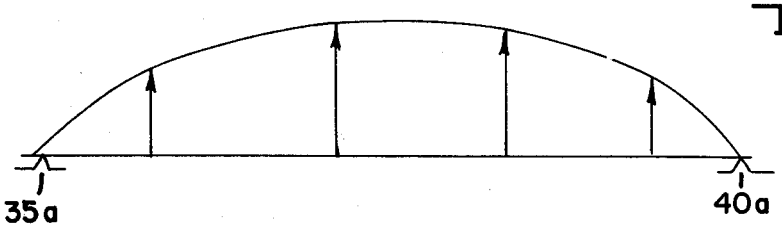
Fig. 14
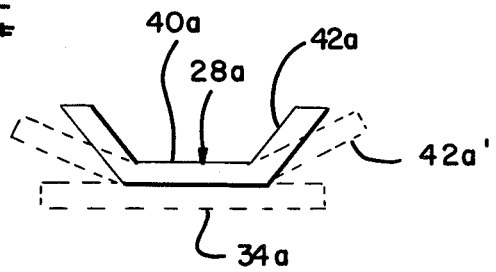

CONNECTING MEANS FOR MAKING CONNECTIONS TO FINE WIRES

BACKGROUND OF THE INVENTION

This invention relates to electrical connecting means for forming electrical connections to extremely fine wires, for example, wires in the range of AWG 32–50. Wires in this gauge range are frequently used for coil windings in many types of electrical devices and they are ordinarily insulated with a varnish type insulation such as polyvinyl formal resin. The electrical coils are usually quite small in themselves and it is desirable to have a terminal or other connecting means which is as small as possible for the coils.

U.S. Pat. No. 4,026,013 discloses and claims a connecting means for extremely fine wires in the form of an insulating body having a cavity therein which receives a trapezoidal shaped terminal device. One external surface of the terminal device is provided with serrations which penetrate the varnish type insulation of the wire when the wire is forced against this surface. The terminal device is slightly oversized relative to the dimensions of the cavity so that it is collapsed to some extent when it is forced into the cavity. In accordance with the teachings of U.S. Pat. No. 4,026,013, a portion of the wire is located against one wall of the cavity and the terminal is thereafter forced into the cavity with the serrated surface against the wire. The partial collapse of the terminal results in the accumulation of stored energy in the terminal which urges the serrated surface of the terminal against the wire so that electrical contact is established with the wire and the stored energy of the terminal assures the achievement of a stable and long lived electrical connection.

Connecting means of the type shown in the above identified U.S. Pat. No. 4,026,013 have received an enthusiastic reception in the electrical industry, particularly among manufacturers faced with the problem of forming electrical connections to the wires of relatively small coils. While the electrical connecting means shown in that patent is quite small, there are nonetheless circumstances where an even smaller terminal and connecting means are required. The instant invention is, therefore, directed to the achievement of an electrical connecting means of the general class disclosed in U.S. Pat. No. 4,026,013 which is, however, significantly smaller, other things being equal, than the connecting means of the prior art and which can, therefore, be used under extremely demanding circumstances as regards space limitations.

In accordance with the teachings of the instant invention, a terminal is provided which has a contact arm and a wedge arm which is disposed beside, and held slidably against, the contact arm. The terminal is dimensioned to be received in a cavity provided in a coil bobbin or the like in which a portion of the wire is positioned. The terminal is then inserted into the cavity with the contact arm extending beside the wire and the wedge arm is thereafter slid along the contact arm and serves to force the contact arm against the wire and clamp the wire against a side of the cavity. Serrations are provided in the contact arm as taught in U.S. Pat. No. 4,026,013 for penetrating the varnish type insulation of the wire and establishing the electrical contact. Furthermore, the contact arm and the wedge arm are constructed such that after the wedge arm is moved to its wedging position, stored energy is accumulated in the terminal which maintains the contact arm in intimate engagement with the wire.

It is accordingly an object of the invention to provide an electrical connecting means for extremely fine wires. A further object is to provide a connecting means of extremely small size which can be used under restricted spatial circumstances. A further object is to provide a connecting means comprising a cavity and a terminal which is insertable into the cavity to form an electrical connection with a wire disposed in the cavity. A further object is to provide a terminal for establishing contact with extremely fine wires which can be manufactured at a minimum of cost by conventional die stamping and forming methods.

These and other objects of the invention are achieved in preferred embodiments thereof which are briefly described in the foregoing abstract, which are described in detail below, and which are shown in the accompanying drawing in which:

in FIG. 1 the connecting means of the invention serves to connect the tap wires of the windings to conductors on a flexible circuit.

FIG. 9 is a view of an alternative form of terminal in accordance with the invention.

FIG. 10 is a view similar to FIG. 1 showing the means in which the terminal of FIG. 9 serves to connect the coil windings to the conductors of the flexible circuit.

FIGS. 11 and 12 are diagrammatic views which illustrate the manner in which the contact arm of the terminal is brought into engagement with the wire.

FIG. 13 is a load diagram which illustrates the loading of the contact beam when it is in engagement or contact with the wire.

FIG. 14 is a diagrammatic view which illustrates the manner in which the wedge arm is resiliently deformed when the electrical contact with the wire is made.

Figure 1:
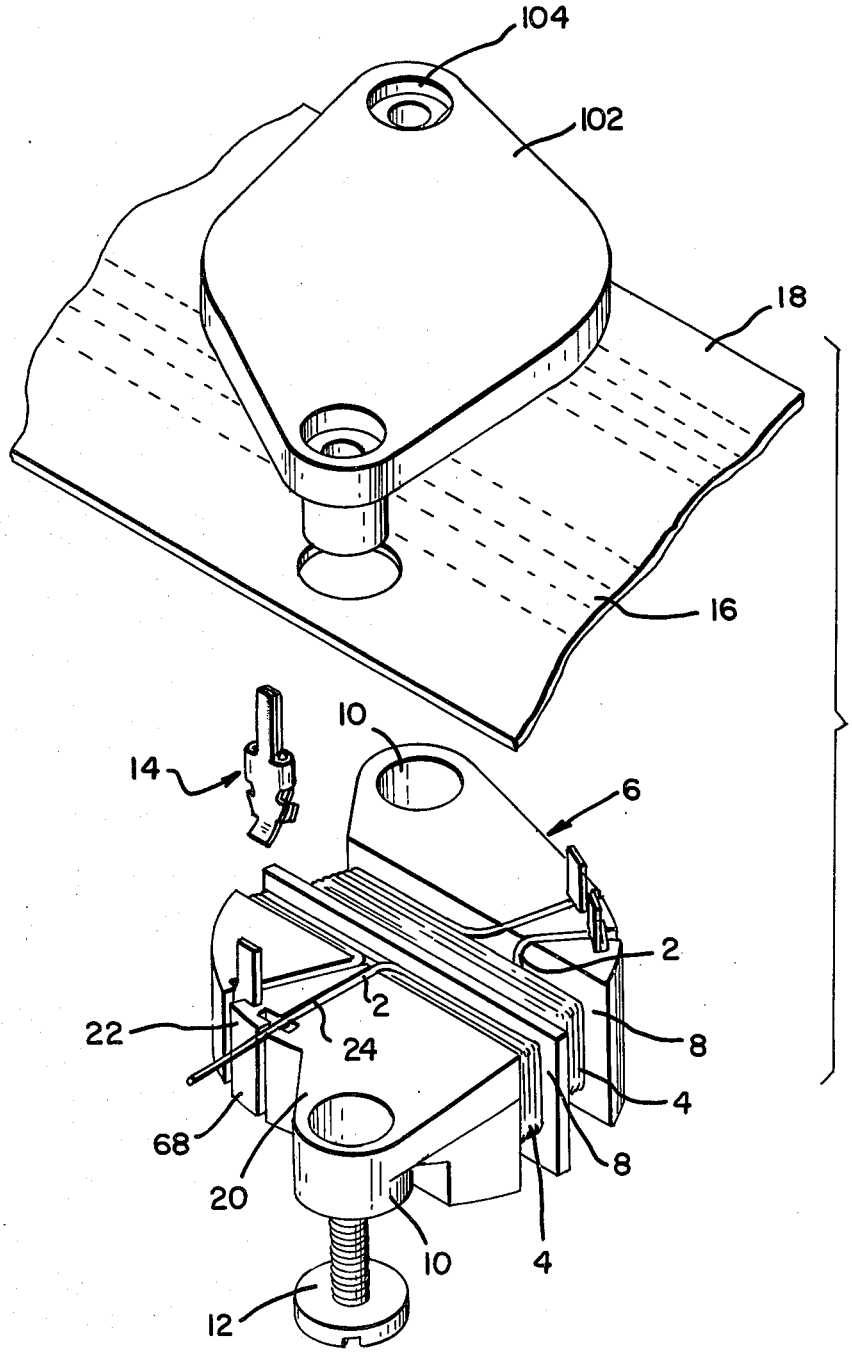
FIG. 1 is a perspective view of a bobbin having fine wire coils wound thereon and having connecting means in accordance with the invention integral therewith.

The embodiment shown in FIGS. 1–8 serves to connect the tap wires 2 of the coil windings 4 on a plane or bobbin 6 to conductor 16 of a flexible circuit 18. The frame or bobbin 2 has side-by-side relatively deep depressions or recesses 8 extending therearound in which the windings are located and shallow channels 24 extend from these windings to side surfaces 68 of the bobbin and to the individual termination sites for each wire. The bobbin 6 has mounting ears 10 extending therefrom which are adapted to receive mounting screws 12 so that the flexible circuit 18 can be clamped between the surface 20 of the bobbin and the surface of a housing or other mounting means (not shown) in which the circuit 18 and the bobbin 6 are contained. The particular bobbin shown is used and forms part of the shutter control mechanism of a movie camera, however, it will be understood that the principles of the invention can be used to a wide variety of similar and equally demanding circumstances.

The connecting means in accordance with the invention comprises a terminal 14 for each wire and a cavity 22 which extends into the surface 20 of the bobbin and which is dimensioned to receive the terminal in a manner described below. In the description which follows, the terminal 14 will first be described in detail and the details of the cavity 22 will thereafter be described.

The terminal 14 comprises a realtively elongated contact arm 26 and a wedge arm 28 which is disposed against one surface 39 of the contact arm. The contact arm 26 has solder tab portion 30 at its upper end, an intermediate shank portion 32, and a wire contact portion 34 at its lower end as viewed in FIG. 4. Serrations 36 extend transversely across the contact portion adjacent to the lower end 38 on the side thereof which is opposite to the side 39. The intermediate shank portion 32 and the solder tab portion 30 of the contact arm are coplanar with each other while the contact arm portion extends obliquely past the side 39 and past the lower end 40 of the web arm as shown clearly in FIG. 4. Laterally extending retention barbs 33 extend from the side edges of the shank portion adjacent to the contact portion and these retention barbs are also coplanar with the shank portion and the solder portion of the contact arm. As will be explained below, these barbs penetrate the sidewalls of the cavity 22 and retain the contact arm in the cavity after insertion.

Figure 2:
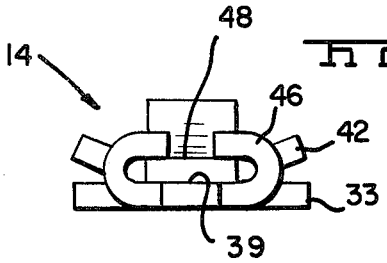
FIG. 2 is an end view of the terminal of the connecting means of FIG. 1.
Figure 3:
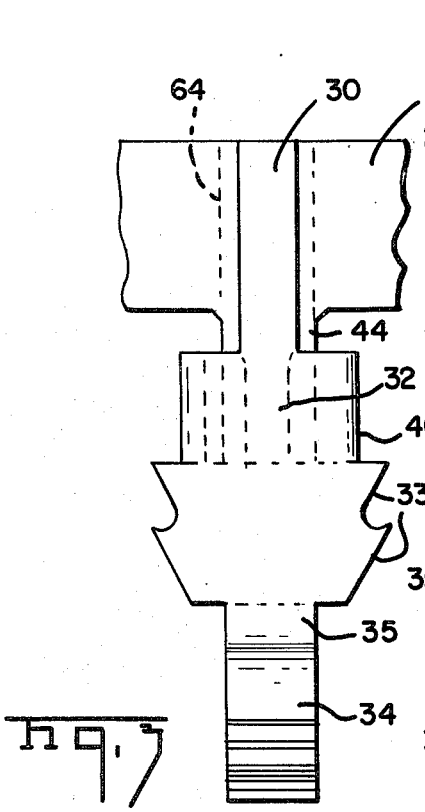
FIG. 3 is a frontal view of the electrical terminal.

The wedge arm 28 has similar retention barbs 42 adjacent to its lower end 40 although these retention barbs extend obliquely from the plane of the web arm and, therefore, extend angularly with respect to the barbs 33 as shown in FIG. 2. The upper portion of the web arm 44 is of uniform width and is slightly wider than the solder tab portion 30 of the contact arm. As shown in FIG. 3, the upper portion of the wedge arm is integral with the continuous carrier strip 50 from which it is sheared along shear lines 64 when the terminal is inserted into a cavity 22. The wedge arm 28 is held in assembled relationship to the contact arm by laterally extending reversely formed ears 46 which are integral with the shank portion 32 of the contact arm and which embrace the wedge arm immediately above the upper set of retention barbs 42. The forming of these ears should be such that the wedge arm is permitted to slide downwardly from the position of FIG. 4 over the surface 39 of the contact arm and ears serve to guide the wedge arm along a straight line path during such movement as will be explained below.

Figure 4:
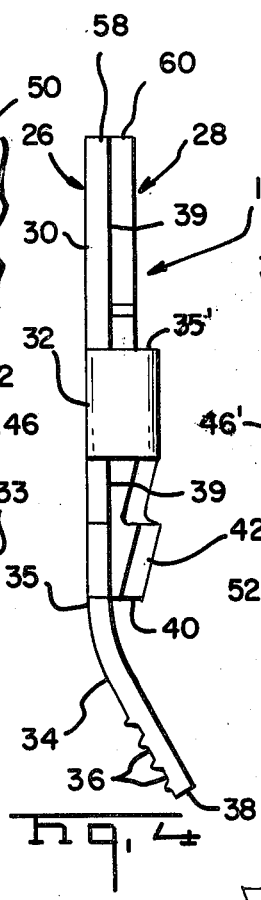
FIG. 4 is a side view thereof.
Figure 5:
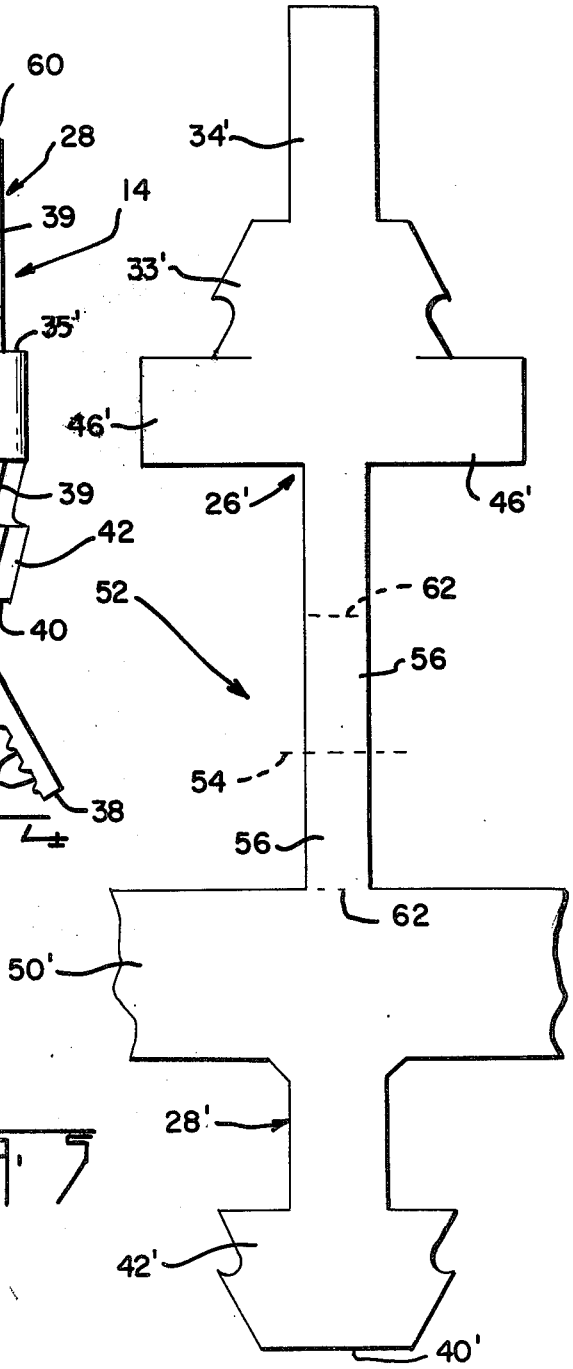
FIG. 5 is a plan view of the stamped blank from which a terminal in accordance with the invention is formed.

Electrical terminals of the type shown in FIG. 2–4 are advantageously manufactured in the form of a continuous strip as shown in FIG. 5. This strip is fed to an insertion machine which serves to separate the leading terminal from the strip and insert it into a cavity. The blank 52 is shown in FIG. 5 with the corresponding parts of the blank and the formed terminal being identified by the same reference numerals, but differentiated by prime marks. It will thus be seen that the blank is manufactured by punching a continuous strip of sheet metal so as to provide a narrow central connecting strap which ultimately forms the solder tab portion 30 of the terminal. The wedge arm 28 is formed by the portion 28′ of this blank which lies to the right in FIG. 5 of the connecting central section and the contact arm 26 is formed by a portion 26′ of this central connecting neck and the other blank portions 33′, 34′, and 46′. The continuous strip of terminals is produced by first forming the section 42′ of the blank to bend the retaining barbs downwardly from the plane of the plane of the strip. Thereafter, the strip is folded along a fold line 54 so that the wedge arm portion 28′ is disposed against the contact arm portion 26′ with the end 40 of the wedge arm located at the upper end 35 of the contact arm 34. The blank portions 46′ are then formed upwardly and inwardly toward each other to form the ears 46 and finally, the fold in the strip is sheared along the lines 62, thereby, to separate the wedge arm from the contact arm. After the shearing operation, the upper ends 58, 60 of the contact arm and the wedge arm are at the same location as shown in FIG. 4 and the wedge arm can be moved downwardly from the position of FIG. 4 under the guidance of the reversely formed ears of the contact arm.

Each of the cavities 22 extends into the surface 20 of the housing, through the housing to the underside 66 thereof and communicates with a side surface 68 by means of an opening 80.

Figure 6:
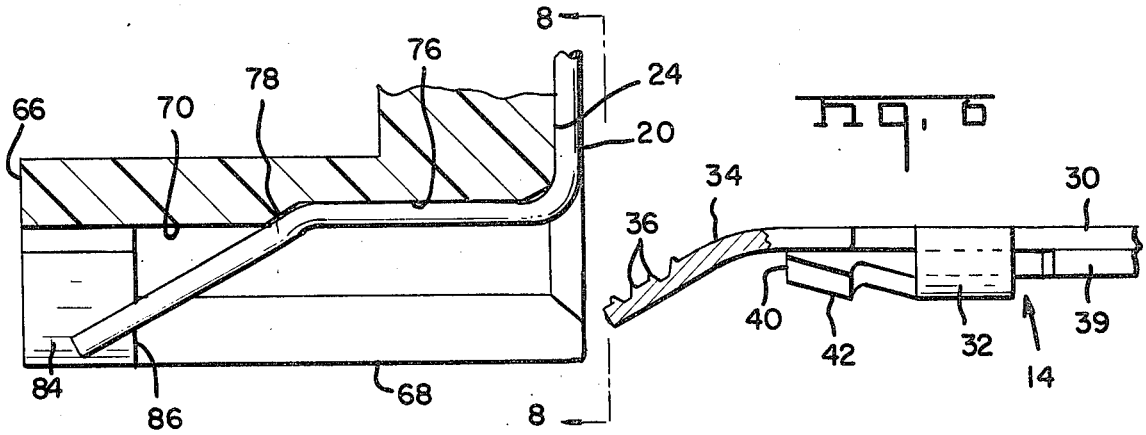
FIG. 6 is a sectional side view of a cavity which is dimensioned to receive the terminal of FIGS. 2–5.

Each cavity 22 has opposed sidewalls 70, 72, the side 70 being the inner sidewall into which the wire-receiving channel 24 extends. As shown in FIG. 6, the channel 24 merges with a relatively narrow and shallow groove 76 in the sidewall 70 and this groove extends partially along the sidewall 70 and ends in a ramp 78 which merges with the lower portion of the sidewall. Relatively narrow sidewalls 74 extend between the sidewalls 70, 72.

The slot 80, as previously mentioned, extends along the surface 68 and opens into the cavity so that the wire can be placed in the channel 24 and passed through the slot 80 so that it will be located in the groove 76 and against sidewall 70. The inner end 86 of the cavity 22 is adjacent to the lower surface 66 of the housing and the opposed sides 84 of the slot 80 slope towards each other adjacent to the inner end 86 of the cavity so that a narrow positioning guide 88 for the wire is defined adjacent to the surface 66. It will thus be apparent that if the wire is simply located in the channel 24, and passed through the opening 80 while it is being held taut under a slight tension, the wire will locate itself in the shallow channel 76 and in the confined area 88 so that a portion of the wire will extend along the sidewall 70 between the ramp 78 and the locating portion 88 as shown in FIG. 6. The operation of placing the wire in the cavity can be carried out at the time of winding the coil and can be carried out by the automatic winding machinery if desired.

Figure 7A:
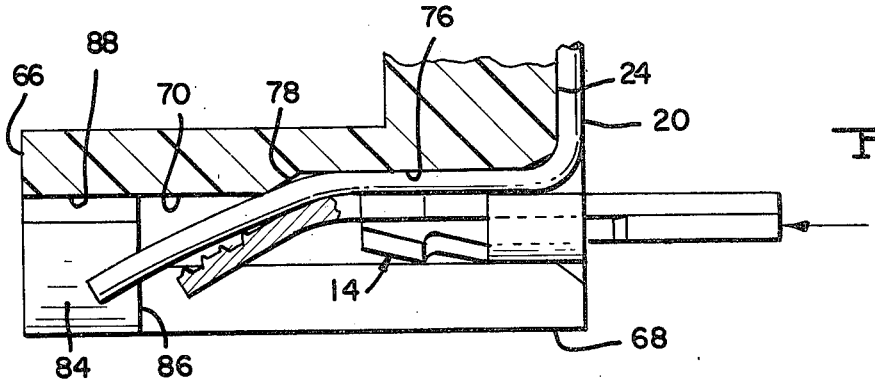
FIG. 7A is a view similar to FIG. 6 but showing the positions of the parts after insertion of the terminal into the cavity but prior to movement of the wedge arm to its fully inserted position.
Figure 7B:
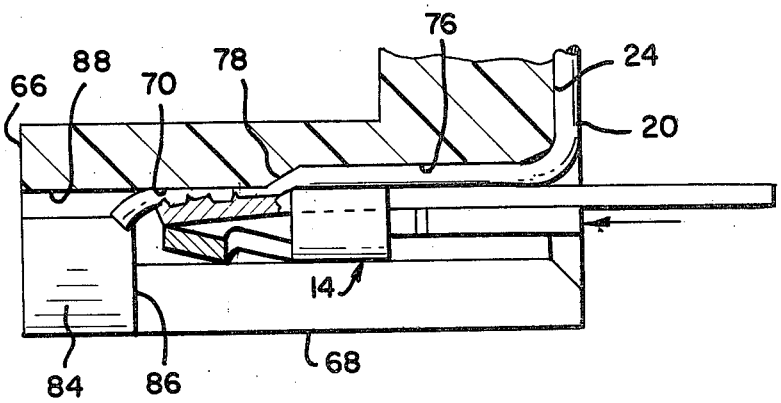
FIG. 7B is a view similar to FIG. 7A but showing the parts after full insertion of the wedge arm relative to the contact arm.
Figure 8:
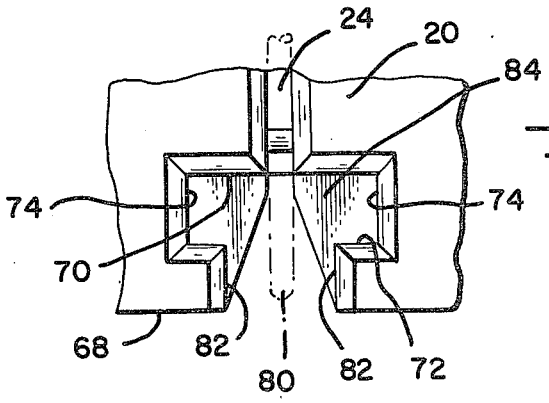
FIG. 8 is a view looking in the direction of the arrows 8—8 of FIG. 6.

After the wire has been located in the cavity as described above, the terminal is inserted into the cavity in an orientation such that the contact arm 34 is opposed to the wire, see FIG. 7A. The terminal is inserted as a unit to a depth such that the edges 33 of the retaining ears 32 are coplanar with the surface 20. Thereafter, an insertion force is applied against the end 60 of the wedge arm 28 to cause it to be slid along the side 39 of the contact arm 26 until the wedge arm is fully inserted as shown in FIG. 7B. During such movement of the wedge arm, the lower end or contact portion 34 of the contact arm will be bent towards the sidewall 70 and the wire will be clamped between the insulation piercing serrations 36 of the contact arm and the sidewall 70. These serrations will penetrate the insulation of the wire and establish electrical contact therewith. After such electrical contact is established, the solder post or tab portion 30 of the contact arm is electrically connected by soldering to the conductor 16 of the flexible circuit and the assembly comprising the housing and the circuit 18 is secured by the fasteners 12 to the surface of the housing in which the circuitry is contained.

It will be apparent that the practice of the invention achieves a substantial saving in space as compared to previously known termination means for forming electrical connections with fine wires in the range of AWG 32 to AWG 50. The terminal may be made in a relatively small size, for example, a terminal which is suitable for the wire range noted above has an overall length of 0.22 inches, an overall width as measured between the barbs 33 of 0.08 inches, and an effective thickness of 0.035 inches (as measured between the external surface of a contact arm and the inner edge of the contact portion of the contact arm). The cavity which receives the contact terminal will thus have dimensions which will be only slightly greater than those of the terminal. Terminals for wires of this size range are advantageously manufactured from brass strip stock having a thickness of 0.008 inches in a number 2 hard temper.

It has been found that an extremely stable and effective electrical connection between the terminal and the fine wire is achieved in accordance with the principles of the invention. The wedge arm 28 is guided and confined during its downward movement along the contact arm between ears 46 and after the electrical connection has been established with the fine wire, the wedge arm provides a reservoir of stored energy which continually urges the lower end of the contact arm into engagement with the wire.

For best results, the wedge arm, the contact arm, and the cavity in the bobbin should be dimensioned and the materials should be chosen such that the contact arm is deformed and loaded by the wedge arm as illustrated in the diagrams of FIGS. 11–13. In FIG. 11, the contact arm is diagrammatically shown in its normal or unstressed condition at 34*a* and the reference numerals in FIGS. 11–14 generally correspond to those used in the previous description but are differentiated by the post script "a" to indicate that these figures are diagrammatic. In FIG. 11, the end 40*a* of the wedge arm is located at the inner end 35*a* of the contact arm 34*a*. After the terminal has been inserted into the cavity and the wedge arm has been moved to its fully inserted position, the wedge arm supports the contact arm in the manner shown in FIG. 12; the end 40*a* of the wedge arm is located at the end 38*a* of the contact arm and an intermediate portion of the wedge arm extends past and supports the upper or inner end 35*a* of the contact arm. The contact arm is thus loaded in the manner of a simple beam which is freely supported at its ends 35*a*, 40*a*, the load on the beam being, of course, the load imposed by the wire and the wall of the cavity. As shown in FIG. 13, this load is distributed along the length of the contact arm with the maximum load being located in the center portions of the beam. It will be apparent that the contact arm in its loaded condition is capable of compensating for any relaxation in the housing or in the wire, for example, relaxation which may be a result of temperature fluctuations or flow. By virtue of this phenomenon, a stable electrical connection is achieved over a wide range of temperatures and for a prolonged time period.

FIG. 14 diagrammatically illustrates another feature of the invention which contributes to the stability and durability of the electrical connection achieved. In this view, the end portion 40*a* of the wedge arm 28*a* is shown in its normal condition in the solid lines. The cross section of the lower portion of the wedge arm will have the shape shown in these solid lines prior to its downward movement along the contact arm. After the wedge arm is moved to its fully inserted position the divergent obliquely extending ears 42*a* ' will be flexed downwardly as viewed in FIG. 14 towards the contact arm 34*a* which is also shown in dotted lines in this figure. This flexure of the ears 42*a* is imparted to them by the load imposed on the wedge arm by the contact arm 34*a*.

FIG. 14 shows the conditions which exist on the right hand end of the diagram of FIG. 12. It is assumed in FIG. 12 that the contact arm is supported at its end 38*a* in the manner of a simple beam. This assumption requires that the support for the end 38*a* of the contact arm be stable and unremitting. The resilient flexure of the ears 42*a* provides such stability in that any dimension of changes which might be brought about by temperature fluctuations would be counteracted by the flexure in the ears 42*a*; in other words, these ears would tend to return to their solid line positions of FIG. 14 and follow the contact arm thereby to maintain the stability of the beam system shown in FIG. 12.

The diagrammatic views of FIGS. 11–14 are presented for the purpose of explaining the phenomena which contributes to the stability of the electrical connection achieved in the practice of the invention and they are not presented as quantitative representations. They do explain the manner in which a stable electrical connection is achieved within the confines of the extremely limited space of a small coil bobbin.

FIGS. 9 and 10 show an alternative embodiment of the invention comprising terminal 90 which, like the terminal of the previously described embodiment, has a contact arm and a wedge arm, the wedge arm being intended to be moved along the contact arm to bend it into engagement with the wire. In this embodiment, the two arms are formed integrally with each other by means of a connecting strap generally indicated at 92 which extends obliquely as shown at 94 from the shank portion of the contact arm and is reversely bent at 98 to provide a section 96 which extends towards, and is integral with, the wedge arm. A contact boss 100 is formed in the section 96 of the strap for engagement with a circuit pad as the terminal has been connected to a wire. In the use of this embodiment as shown in FIG. 10, the wire is positioned in the cavity as described above and the terminal is inserted to locate the end of the contact arm adjacent to the wire. Thereafter, the wedge arm is pushed downwardly and the strap section 94, 96 is reformed so that the section 96 extends horizontally and parallel to the upper surface of the housing. After such insertion and forming of the strap portion 96, the bobbin can be placed against the surface of the flexible circuit 18 and the flexible circuit can be clamped against the upper surface of the bobbin by means of a clamping member 102 which has threaded openings 104 for reception of screws 12. In this embodiment the flexible circuit is clamped by the clamping member 102 and the upper surface of the bobbin and the contact bosses are held in engagement with the conductors.

What is claimed is:

1. An electrical terminal which is intended for establishing electrical contact with a wire which extends into a cavity in a housing, said terminal comprising:

a contact arm and a wedge arm, said contact arm having a shank portion and having a contact portion, said shank portion being substantially straight, said contact portion extending obliquely from one end of said shank portion past one side of said shank portion, said wedge arm being against said one side of said shank portion, said contact arm and said wedge arm being held against each other by holding means, said holding means permitting sliding movement of said wedge arm along said one side of said shank portion and over said contact arm towards the end of said contact arm whereby, upon inserting said terminal, contact arm first, into said cavity with said contact arm beside said wire, and upon sliding said wedge arm along said contact arm, said contact arm is moved against said wire and clamps said wire against a wall of said cavity thereby to establish electrical contact with said wire.

2. A terminal as set forth in claim 1, said holding means comprising holding ear means on one of said arms, said holding ear means being folded over and embracing the other one of said arms.

3. A terminal as set forth in claim 2, said ear means being integral with said shank portion of said contact arm.

4. A terminal as set forth in claim 3, said contact arm and said wedge arm having retaining ears extending from side edges thereof for retaining said arms in said cavity.

5. A terminal as set forth in claim 1, having connecting strap means integral with said contact arm and said wedge arm, said connecting strap means constituting said holding means.

6. An electrical connecting means for establishing an electrical connection with a wire comprising:

a body of insulating material having a cavity extending into one surface thereof, an electrical terminal which is intended for insertion into said cavity, said terminal comprising a contact arm and a wedge arm, said contact arm having a shank portion and having a contact portion, said shank portion being substantially straight, said contact portion extending obliquely from one end of said shank portion past one side of said shank portion, said wedge arm being against said one side of said shank portion, said contact arm and said wedge arm being held against each other by holding means, said holding means permitting sliding movement of said wedge arm along said one side of said shank portion and over said contact arm to the free end of said contact arm, said cavity being dimensioned to receive the combined thickness of said contact arm and said wedge arm with a snug interference fit whereby, upon placement of a portion of said wire in said cavity with said wire extending along one wall of said cavity, and upon insertion of said terminal, contact arm first, into said cavity with said contact arm beside said wire, and upon thereafter sliding said wedge arm along said one side of said shank portion and over said contact arm, said contact arm is bent towards said one wall of said cavity and clamps said wire against said one wall, and said contact arm is, thereby, electrically connected to said wire.

7. An electrical connecting means as set forth in claim 6, said body having a surface which is opposite to said one surface and having a side surface which extends between said zone surface and said opposite surface, said cavity extending through said body to said opposite surface, and a slot extending into said side surface and communicating with said cavity whereby, said wire can be placed in said cavity by passing said wire laterally of its axis, through said slot, and into said cavity.

8. An electrical connecting means as set forth in claim 7, said body comprising coil bobbin.

9. An electrical connecting means as set forth in claim 7, said holding means comprising holding ear means on one of said arms, said holding ear means being folded over, and embracing, the other one of said arms.

10. An electrical connecting means as set forth in claim 9, said holding ear means being on said contact arm intermediate the ends thereof.

11. An electrical connecting means as set forth in claim 10, said contact arm having an additional contact portion extending from said shank portion at the end thereof which is opposite to said one end.

12. An electrical connecting means as set forth in claim 11, said additional contact portion comprising a solder tab.

13. An electrical connection of a fine wire to a terminal comprising:

a body of insulating material having a cavity extending into one surface thereof, said wire extending into said cavity and being against one wall of said cavity, a terminal inserted into said cavity, said terminal comprising a contact arm and a wedge arm, said contact arm having a shank portion and a contact portion extending from said shank portion, said contact portion being against said wire and said one wall, said wedge arm being against said contact arm on the opposite side surface thereof from the side disposed against said wire and said one wall, said contact arm and said wedge arm being force fitted into said cavity between said one wall and the wall which is opposite to said one wall, said contact arm being maintained in a flexed condition by said wedge arm and being held against said wire in the manner of a simple beam, said contact arm being in a deformed and stressed condition so that said contact arm is resiliently held against said one wall and said wire and is maintained in contact with said wire.

14. An electrical connection as set forth in claim 13, said body of insulating material comprising a bobbin having a coil wound thereon, said wire extending across said surface to said coil.

15. An electrical connection as set forth in claim 14, said shank portion having an additional contact means extending therefrom and beyond said surface for connecting said wire to an additional wire.

16. An electrical connection as set forth in claim 15, said additional contact means comprising a solder tab.

17. An electrical connection as set forth in claim 13, said wedge arm being resiliently stressed transversely of its length adjacent to said contact arm whereby said wedge arm is resiliently urged against said contact arm.

* * * * *